US005335607A

United States Patent [19]

Wilcox

[11] Patent Number: 5,335,607

[45] Date of Patent: Aug. 9, 1994

[54] RUBBER TIRE COMBUSTER

[76] Inventor: Ernest J. Wilcox, Montezuma, Iowa

[21] Appl. No.: 139,817

[22] Filed: Oct. 22, 1993

Related U.S. Application Data

[63] Continuation-in-part of Ser. No. 978,479, Nov. 18, 1992.

[51] Int. Cl.[5] ..... F23B 7/00

[52] U.S. Cl. ..... 110/233; 110/212; 110/234; 110/235; 110/317; 237/1 R

[58] Field of Search ..... 110/229, 235, 242, 212, 110/203, 245, 317, 320, 233, 234; 237/1 R

[56] References Cited

U.S. PATENT DOCUMENTS 4,038,032 7/1977 Brewer et al. ..... 110/212 X
4,052,140 10/1977 Highley ..... 431/7
5,101,739 4/1992 Nance et al. ..... 110/229

*Primary Examiner*—Edward G. Favors

[57] ABSTRACT

A furnace for burning rubber tires. The furnace has a unique divided and apertured fire box to delay burning so that more complete combustion is complete. Forced air, and afterburner and a converter section also combine to provide for near smokeless discharge from the exhaust of the furnace.

10 Claims, 3 Drawing Sheets

RUBBER TIRE COMBUSTER

This is a continuation in part of U.S. application Ser. No. 07/978,479, filed Nov. 18, 1992.

BACKGROUND AND SUMMARY OF THE INVENTION

This invention pertains to devices for the disposal of worn-out rubber tires, and more particularly to a furnace for incinerating the tires. This application is a continuation in part of a prior application by the same applicant, Ser. No. 07/978,479 filed Nov. 18, 1992.

Worn-out or otherwise discarded rubber tires are one of the principal problems in the field of waste disposal. When placed in a land fill, a tire frequently "floats" to the surface and requires reburial. Storage of such tires provide excellent breeding grounds for mosquitoes if any water whatsoever is caught in the tire. Open burning of tires causes dense, dark smoke full of unwanted particulates as well as undesirable combustion gasses such as oxides of sulfur which when combined with water in the air form undesirable acidic liquids.

In spite of the problems of burning the tires, incineration still seems the best disposal method. However, it is necessary to have some device to enhance a complete burning including the burning of much of the particulate material in the normal smoke.

This invention accomplishes such complete burning. The initial burning is done in a chamber having a relatively large air space and uses forced air for combustion. However, the rate of burning of the tires is limited by providing successive burning in two spaces in a single large chamber. Additionally, an afterburner is used and a converter similar to a catalytic converter for an automobile may be used for added enhancement of the combustion process. A more complete understanding of the invention may be had by a study of the following description and the figures in which:

DESCRIPTION

Figure 1:
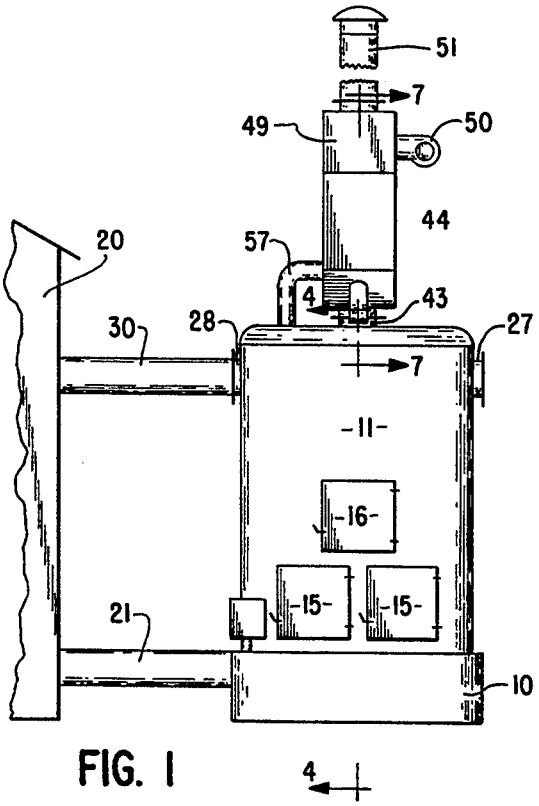
FIG. 1 is a front elevational view of the furnace externally of the building in which the generated heat may be used.

Briefly this invention pertains to incinerators and more particularly to a furnace-type incinerator using auxiliary devices to obtain full and complete combustion of rubber compounds such as found in rubber tires. More specifically, the invention comprises a furnace having a base 10. The outer jacket 11 is supported from the base and serves as an enclosure for the entire furnace part of the device. Within the jacket 11 is a combustion chamber enclosure 12. Fins 13 may be fixed to the enclosure 12 to improve heat transfer from the combustion area to the plenum chamber 14.

For reasons, to be explained later, two charging doors 15 and possibly a single upper charging door 16 are preferably used for access to the fire pot chamber. The fire pot chamber is defined by an outer wall 17 and a bottom floor 18. It is into this chamber and through the doors 15 or 16 that the rubber to be burned is loaded. Preferably that rubber has been cut into small pieces so that the furnace can be readily charged for burning.

In this type of installation, heated air is truly a by-product of the combustion and therefore circulating air for cooling the combustion chamber is a requirement rather than the means by which a volume of space is desirably heated. Therefore, the circulating air will be referred to as cooling air as it enters the furnace and as heated air as it exits. Because the heated air may be a useful by-product, the furnace is illustrated adjacent a building 20 (FIG. 1). Cooling air may be drawn from the building through a cooling air duct 21 and into a fan box 22. A fan 23 within the box 22 is adapted to draw the air through the duct 21 and simply exhaust into the box 22. From the box 22 the blown air enters the base 10 through an opening 25. It leaves from the base through openings 26 into the space between the outer jacket 11 and the chamber enclosure 12. From this space it is exhausted through one of two pipes near the upper part of the furnace. The first pipe 27 is simply an exhaust to outside air and is used when heating air in the building is undesirable. The second pipe 28 is connected by a duct 30 to the building 20 around which it may be distributed by any desirable system of ducts and heater openings. Closure means may be provided by which either pipe may be closed so as to be unusable during the time the other pipe is in use. Such closure may be any sort of plate, damper or the like as may be in common use. It should be noted that while the illustrated heat exchange to air is preferred, the furnace jacket could be a water jacket or boiler as well.

Figure 2:
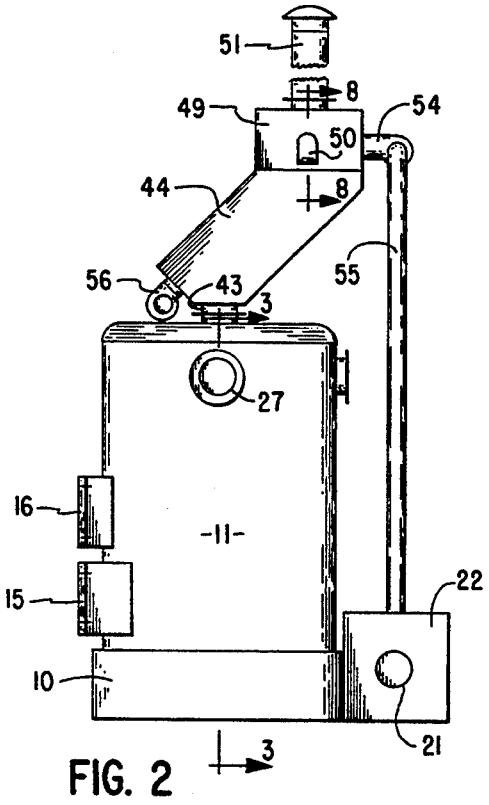
FIG. 2 is a side elevational view of the furnace of FIG. 1.
Figure 4:
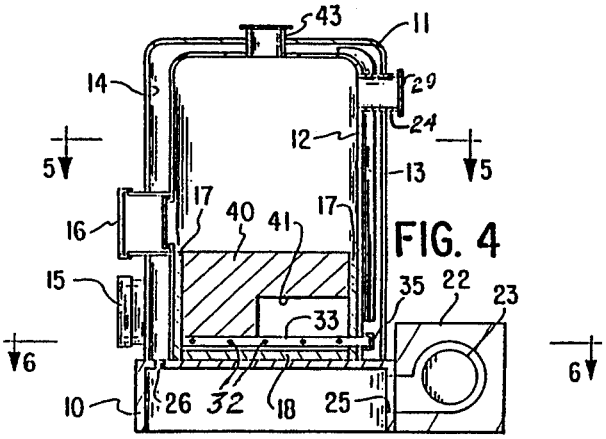
FIG. 4 is a sectional view of the lower combustion device from line 4—4 of FIG. 1.

A safety device may be provided to relieve excess pressure in the fire pot. That device, as illustrated in FIGS. 2 and 4, is simply another opening through a pipe 24 which is closed by a plate 29. The plate is sealed so that it can be blown off the pipe if the pressure in the fire pot is too great.

Figure 3:
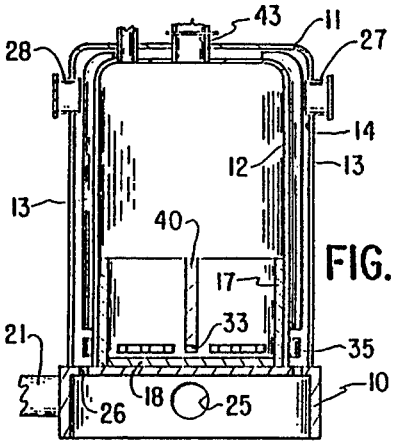
FIG. 3 is a media sectional view of the lower combustion device from line 3—3 of FIG. 2.
Figure 6:
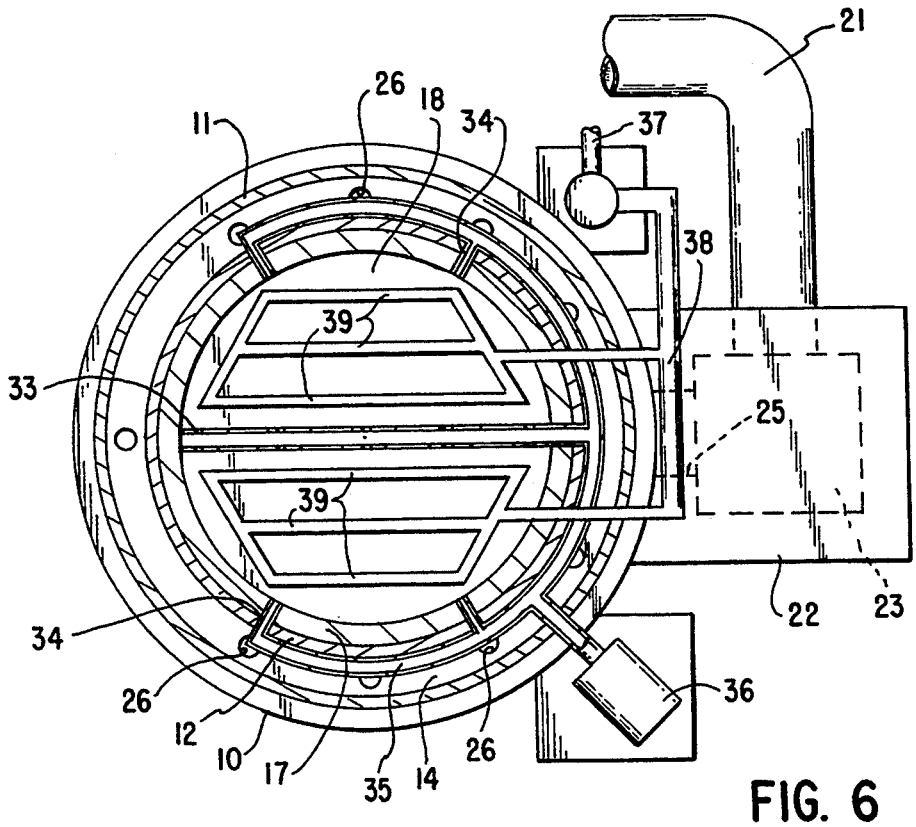
FIG. 6 is a view similar to FIG. 5 but from the plane of line 6—6.
Figure 5:
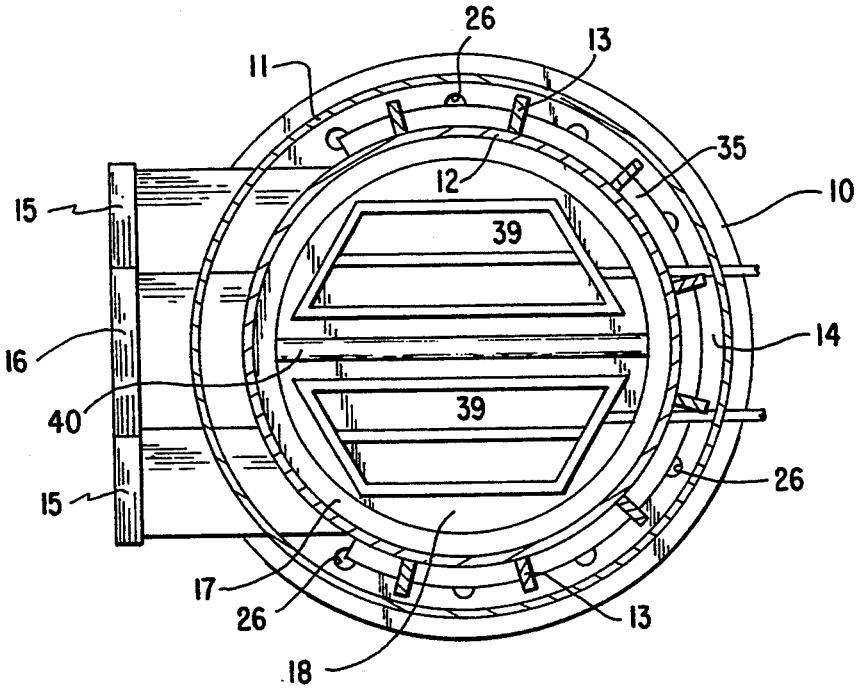
FIG. 5 is a sectional view of the entire base taken from the plane of line 5—5.

Within the fire pot and just above the floor 18 are air ducts for the introduction of combustion air. Two types are illustrated. The central duct 33 is shown running centrally of the floor in FIGS. 3, 4 and 6. The air in this duct is provided from a manifold 35 running above the base 10 and around the chamber 13. This manifold receives air from a small fan 36 mounted on the base 10. The fan thus slightly pressurizes the air. Air from the manifold 35 also enters the perimeter of the combustion chamber through openings 34.

A more forceful introduction of air may be accomplished by use of an air compressor (not shown) providing compressed air through a pipe 37 (FIG. 6) and a manifold 38 to the ducts 39 also on the floor 18. These ducts 39 may also have openings in the side similar to the holes 32 illustrated in duct 33.

It will be apparent that if desired, all the ducts could be supplied by a common air source. Because of the need for complete burning, it is preferred to have compressed air in all the ducts as a supplier of a larger volume although at a greater expenditure of energy for that supply. Also, the compressed air is useful in injecting air into and through the liquified rubber which normally is the result of burning tires and the like. This gummy liquid collects in the fire pot, and occasionally blocks air entrances unless the air is compressed and can be forced through the material.

One of the principal differences in this furnace from others is the provision of a separation wall 40 in the fire pot. In order to burn substantial quantity of rubber, it is desirable to be able to load as much as possible into the furnace. However, to control the burning so that it will be complete, it is necessary to burn it somewhat more slowly and with greater amounts of air than would happen with the large exposed open area of the full furnace. Therefore, the wall 40 divides the fire pot into two parts. An opening 41 in the wall allows the combustion to move from the fuel on one side of the fire pot to the other after a substantial amount of the rubber has been burned away, thus allowing a far more easily controlled burn. The opening 41 must be of substantial size so that the combustion will be transferred from one side of the wall to the other. In normal operation, the opening should be at least one-fourth of the horizontal length of the wall and should extend vertically from the floor 18 to approximately the level where the first rubber is burned. That level is slightly above the level to which the furnace is charged with the material to be burned, and will vary with the size of furnace and shape of the fire box. However, in no case should it be more than about two-thirds of the vertical height of the wall 40.

Figure 7:
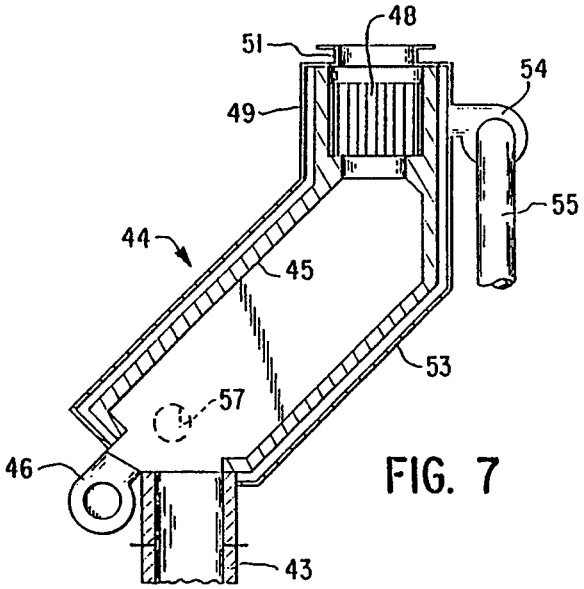
FIG. 7 is a sectional view from line 7—7 of FIG. 1.
Figure 8:
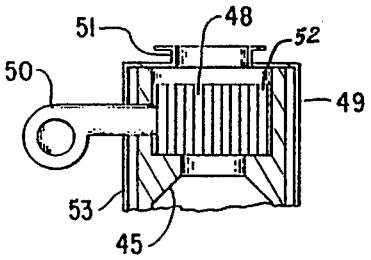
FIG. 8 is a sectional view from line 8—8 of FIG. 2.

The products of the burning are exhausted from the burning chamber through a stack 43 from which they enter the afterburner section 44 shown in section in FIG. 7. This section comprises principally a chamber having a lining 45 of refractory material. An externally fired burner 46 fueled preferably by natural, or liquified petroleum gas or by oil is built into one end of the chamber. To best accommodate the burner, the chamber is built at a slant from the horizontal so That the combustion products enter the chamber nearly vertically from the stack 43 with the burner 46 blowing a flame directly across that entry in a diagonal direction. By thus using a burner flame to ignite and complete the burning of the combustion gases and the particulate carried by those gases, a nearly complete burning of the rubber is possible.

However to be certain burning is absolutely complete, it is envisioned that a catalytic converter core 48 will be provided in the exit stack 49. Fresh air may be provided at this level from a fan 50 to a manifold area 52 so that further combustion will be encouraged before the final gases leave the unit through a stack 51.

Because the afterburner section 44 may readily become overheated, a jacket 53 is provided surrounding the liner 45 and leaving a space through which air may flow. Air is supplied to this space by a fan 54. Air may be conducted to this fan from the fan box 22 through a duct 55. Air blown into the space between the liner 45 and jacket 53 may be exhausted through a hot air duct 57 which runs into the furnace jacket 11. It will be obvious that the exhaust could also be into surrounding air, or through any arrangement which would allow alternate passages into the building 20 or surrounding air.

Thus, by a unique divided fire box and a triple stage of combustion, it becomes possible to burn rubber tires completely with great reduction—to nearly negligible proportion—in the discharge of dangerous pollutants into the atmosphere.

I claim as my invention:

1. An incinerator for burning rubber such as that in rubber tires comprising a fire pot enclosed in a jacket and having a floor, dividing wall means in said fire pot extending from said floor whereby said fire pot is divided into substantially equal parts, said wall being formed with an opening near said floor whereby burning can be started on a first side of said wall and will be continued to the second side as the fuel on said first side is consumed, heat exchanging walls surrounding said fire pot, jacket means surrounding said heat exchanging walls in spaced relationship thereto whereby a heat exchanging chamber is formed between said walls and said jacket means, at least two exits formed in said jacket means, said exit means being arranged so that at least one will be closed while at least another is open so that there are alternate paths of exit, and means to move fluid into said heat exchange chamber as a cooler fluid and through said exit means as a heated fluid.

2. An incinerator for burning rubber such as that in rubber tires comprising a fire pot enclosed in a jacket and having a floor, dividing wall means in said fire pot extending from said floor whereby said fire pot is divided into substantially equal parts, said wall being formed with an opening near said floor whereby burning can be started on a first side of said wall and will be continued to the second side as the fuel on said first side is consumed, combustion air ducts on said floor, said air ducts being formed with discharge holes whereby air can be forced from said ducts through said holes and into said fire pot, said fire pot being adapted to enclose combustion gases after said rubber is burned, a stack on said fire pot to receive said combustion gases, afterburner means having a receiver opening in communication with said stack and outside fueled burner means positioned to blow a flame across said receiver opening whereby said gases will be more completely burned.

3. The incinerator of claim 2 in which said afterburner means is formed with an outlet at an end opposite said fueled burner, said outlet housing catalytic converter means to receive and direct said gases through said converter means, and a stack at the exit from said converter means to direct said gases into the atmosphere.

4. The incinerator of claim 3 in which fan means is attached to said afterburner means near said converter means, said fan being adapted to introduce air into said converter means.

5. The incinerator of claim 2 in which said afterburner means includes a burner chamber having walls of a refractory material, jacket means surrounding said refractory material walls, but spaced therefrom to leave a chamber, and means connected to said chamber to impel a cooling fluid through said chamber.

6. The incinerator of claim 1 in which at least one of said exit means is a duct extending from said jacket to a building whereby said heated fluid can be used to heat said building.

7. The incinerator of claim 6 in which said fluid is air, and fan means is connected to said jacket whereby said fan will move said air through said heat exchanging chamber and said duct.

8. The incinerator of claim 7 in which said heat exchanging walls include fins whereby the heat exchanging function is enhanced.

9. An incinerator for burning rubber such as that in rubber tires comprising a fire pot enclosed in a jacket and having a floor, dividing wall means in said fire pot extending from said floor whereby said fire pot is divided into substantially equal parts, said wall being formed with an opening extending horizontally across at least one-fourth the length of said wall and vertically from a line near said floor upward to a line above the normal level of the rubber being burned whereby burning can be started on a first side of said wall and will be continued to the second side as the fuel on said first side is consumed.

10. The incinerator of claim 9 in which said fire pot is a first stage furnace, a second stage chamber connected to said first stage furnace by a stack, said second stage chamber including a burner adjacent said stack near whereby combustion products from said first stage furnace are subject to further burning, and a third stage section connected to said second stage chamber in position to receive said further burned products, said third stage section including catalytic conversion means to complete the combustion, exhaust means adapted to receive said completely combusted material and to discharge said material into the atmosphere.

* * * * *